US005419553A

United States Patent [19]

Rodgors

[11] Patent Number: 5,419,553

[45] **Date of Patent: * May 30, 1995**

[54] HOCKEY STICK SHAFT

[75] Inventor: Aubrey Rodgors, Surrey, Canada

[73] Assignee: Ronald Salcer, Manhattan Beach, Calif.

[ * ] Notice: The portion of the term of this patent subsequent to Apr. 19, 2011 has been disclaimed.

[21] Appl. No.: 229,379

[22] Filed: Apr. 18, 1994

Related U.S. Application Data

[63] Continuation-in-part of Ser. No. 954,156, Sep. 30, 1992, Pat. No. 5,303,916.

[51] Int. Cl.[6] ..... A63B 59/12

[52] U.S. Cl. ..... 273/67 A

[58] Field of Search ..... 273/67 A, 73 J, 72 R, 273/72 A, 80 R

[56] References Cited

U.S. PATENT DOCUMENTS

| | | | |
|---|---|---|---|
| 4,052,499 | 10/1977 | Goupil et al. | 273/67 A |
| 4,172,594 | 10/1979 | Diedrich | 273/67 A |
| 4,591,155 | 5/1986 | Adachi | 273/67 A |
| 5,050,878 | 9/1991 | Deleris | 273/67 A |
| 5,160,135 | 11/1992 | Hasegawa | 273/67 A |
| 5,217,221 | 6/1993 | Baum | 273/67 A |
| 5,303,916 | 4/1994 | Rodgers | 273/67 A |

*Primary Examiner*—Mark S. Graham
*Attorney, Agent, or Firm*—Rodman & Rodman

[57] ABSTRACT

The improved hockey stick shaft is of elongated tubular configuration, rectangular in cross section, and having opposite open ends. The tubular shaft is formed by pultrusion of a plurality of discrete layers of bondable material including at least one layer of random strand mat glass fibers, at least two layers of 0°/90° balanced plain weave glass fiber fabric, at least two layers of ±45° balanced stitched layered glass fiber fabric, at least one layer of 0° unidirectional carbon fiber roving, and at least one layer of 0° unidirectional glass fiber roving. The layers can be bonded together by a suitable resin, preferably an epoxy resin. When desired, aramid fiber materials can be substituted, in whole or in part, for the corresponding glass fiber and/or carbon fiber materials.

17 Claims, 1 Drawing Sheet

HOCKEY STICK SHAFT

This is a continuation-in-part of U.S. patent application Ser. No. 07/954,156, filed Sep. 30, 1992, U.S. Pat. No. 5,303,916.

BACKGROUND OF THE INVENTION

This invention relates to hockey sticks and more particularly to an improved hockey stick shaft for replaceable hockey blades and handles.

The expanding popularity of hockey at the amateur and professional levels has been fueled by increasing spectator interest in the sport. As a result, there has been a growing demand for hockey equipment, especially hockey sticks.

Hockey sticks have traditionally been a one-piece wooden structure. During a typical hockey game, a hockey stick can impact the ice hundreds of times at force levels that often result in fracture or breakage of the stick. Breakage of a hockey stick occurs most frequently at the blade portion or at the lower part of the shaft that extends from the blade portion. It is thus fairly common for many hockey players to replace a broken stick at least once during each hockey game.

In an attempt to improve the durability of a hockey stick without sacrificing the characteristics of weight, feel, and flexibility that are desirable in a hockey stick, materials other than wood have been resorted to in constructing hockey sticks. Thus, although a wooden hockey stick has set the standard for weight, feel and propulsion of a puck, a new generation of sticks have been formed of plastic and aluminum, as well as laminates of fibrous, plastic and resinous materials. Generally, plastic and aluminum provide good strength characteristics for a hockey stick, but the weight, wear and feel of these materials do not command universal acceptance by hockey players.

Since most hockey players prefer a wooden hockey blade, much attention has been directed to the development of a durable, non-wooden hockey stick shaft that can be used with a wooden blade but is less likely to break than a wooden shaft. One result of such development effort is a hollow aluminum or fibrous hockey stick shaft capable of receiving a replaceable blade that can be formed of wood or plastic.

For example, U.S. Pat. No. 4,086,115 to Sweet, et al. shows a hollow hockey stick shaft made from graphite fiber and resin. The hockey stick includes a wooden blade with a tongue that engages one end of the hollow shaft and is bonded therein with a polyester resin mixture. It has been found that hollow shafts formed of graphite fiber and resin as disclosed in this patent, are more durable than wooden shafts but are still prone to fracture under the usual forces that a stick is subject to in a hockey game.

Thus the problem of shaft breakage or fracture in a hockey stick that includes a hollow shaft, such as disclosed in U.S. Pat. Nos. 4,591,155; 4,600,192; 5,050,878; 4,553,753; 4,361,325; 3,961,790; 4,358,113; 3,934,875 and 4,968,032, has been alleviated but not solved since breakage and fracture are still common occurrences even in aluminum or fibrous material hockey stick shafts.

It is thus desirable to provide a hockey stick shaft that is relatively indestructible during a hockey game, permits replaceable use of blades and an end handle, and retains the flexibility and feel commonly associated with a wooden stick.

OBJECTS AND SUMMARY OF THE INVENTION

Among the several objects of the invention may be noted the provision of a novel hockey stick shaft, a novel hockey stick shaft having a greater resistance to breakage and distortion than aluminum or wood shafts, a novel hockey stick shaft which, if broken, does not splinter or produce shards, a novel hockey stick shaft which has the feel of wood, is shock absorbing and flexes but does not bend permanently, and a novel method of improving the torsional strength and fatigue strength of a tubular hockey stick shaft.

Other objects and features of the invention will be in part apparent and in part pointed out hereinafter.

In accordance with the invention, the hockey stick shaft is an elongated tubular member formed as a plurality of discrete layers of bondable material, preferably bonded together by epoxy resin.

In a preferred embodiment of the invention, the hockey stick shaft has a layer sequence from the outside surface to the inside surface of the shaft of, a) a layer of random strand mat glass fibers,
b) a layer of 0°/90° balanced plain weave glass fiber fabric or 0°/90° aramid fiber fabric,
c) a layer of 0° unidirectional glass fiber roving or 0° unidirectional aramid fiber roving,
d) two layers of ±45° balanced stitched layered aramid or ±45° balanced stitched layered glass fiber fabric, or a combination thereof,
e) a layer of 0° unidirectional carbon fiber roving or 0° unidirectional aramid fiber roving, and
f) a layer of 0°/90° balanced plain weave glass fiber fabric.

The hockey stick shaft is preferably formed by pultrusion and is of substantially uniform wall thickness with opposite open ends adapted to receive a replaceable handle and a replaceable hockey blade.

Under this arrangement, the hockey stick shaft is endowed with torque and twisting strength characteristics that provide good resistance against breakage and distortion, and if broken, the shaft does not produce splinters or shards. The hockey stick shaft is thus non-hazardous in the event of breakage.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figures 1, 2, 3, 4:
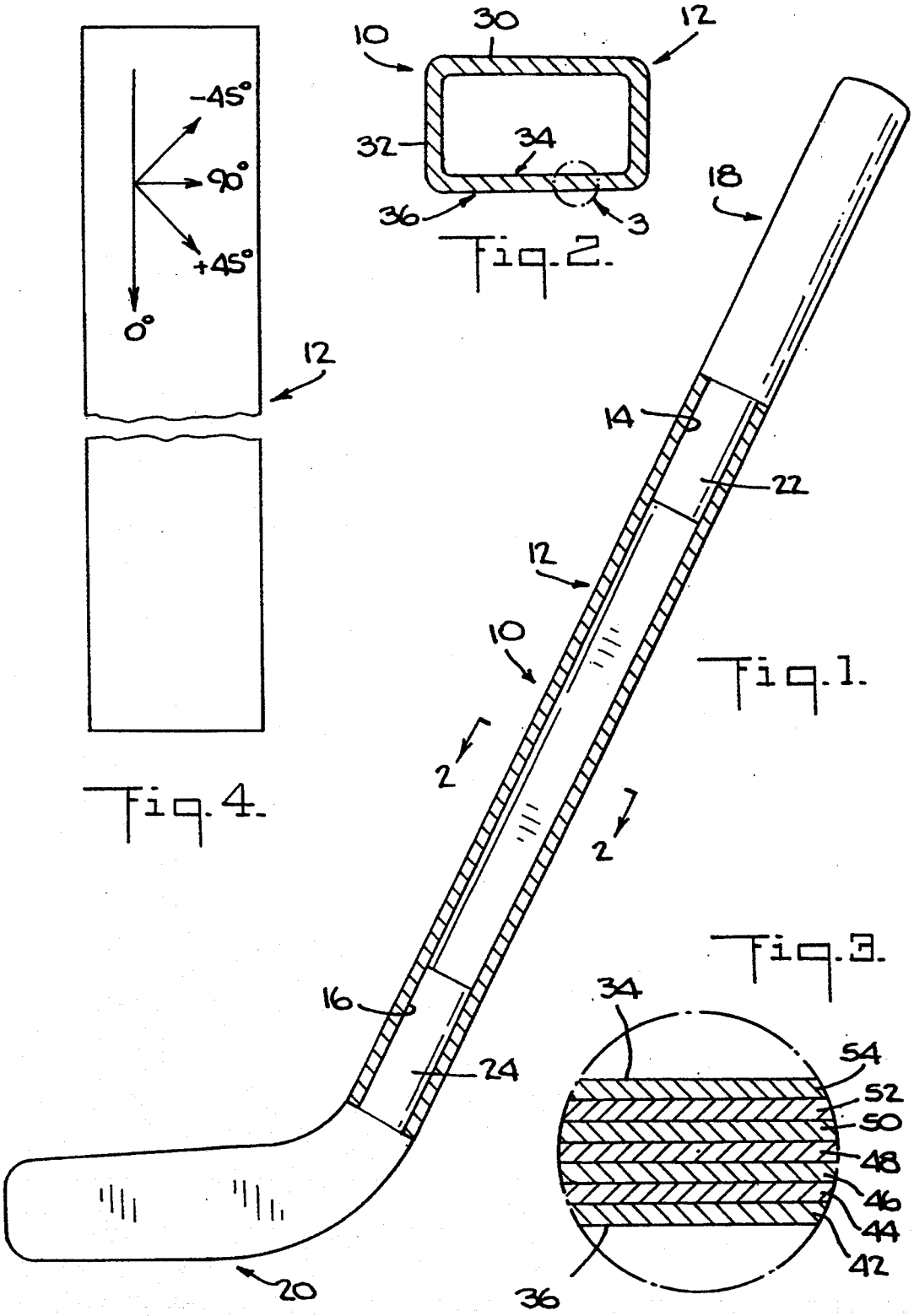
FIG. 1 is a simplified schematic elevation of a hockey stick, partly shown in section, incorporating the shaft of the present invention.
FIG. 2 is a simplified sectional view taken on the line 2—2 of FIG. 1.
FIG. 3 is an enlarged fragmentary detail of section 3 of FIG. 2, showing the laminate structure of the hockey stick shaft.
FIG. 4 is a simplified schematic of the hockey stick shaft showing the angular direction of the layup materials that constitute the hockey stick shaft.

A hockey stick incorporating the present invention is generally indicated by the reference number 10 in FIG. 1.

The hockey stick 10 includes an elongated tubular shaft member 12 of generally rectangular cross section that is approximately 48 inches long with openings 14 and 16 at opposite ends. The shaft 12, in cross section, has a side 30 approximately 1.2 inches wide and a side 32 approximately 0.8 inches wide. The wall thickness of the shaft 12 is substantially uniform and can vary from about 0.070 to 0.1 inches, preferably about 0.075 to 0.095 inches, and most preferably about 0.080 to 0.085 inches. When aramid fiber materials are used, the wall thickness can be reduced to a lower range of about 0.060 to about 0.070 inches.

A replaceable handle 18 includes a reduced neck portion 22 adapted to fit into the opening 14 of the shaft 12, and a replaceable hockey blade 20 includes a similar reduced neck portion 24 adapted to fit in the opening 16. Preferably, the handle 18 and the blade 20 are made of wood.

The reduced neck portions 22 and 24 of the handle 18 and the blade 20 are coated with a conventional hot melt adhesive, which liquifies when heated and solidifies when cooled and can easily be activated from a convenient source such as a conventional portable hand-held hair dryer. The heat is applied to the shaft 12 at the area of the engaged neck portions 22 and 24, and melts the adhesive to activate the bonding action between the adhesive, the neck portions 22 and 24 and the inside surface 34 of the shaft 12.

Referring to FIG. 3, the shaft 12 includes a layup of discrete layers 42, 44, 46, 48, 50, 52 and 54, which can include unidirectional glass fiber roving, unidirectional carbon fiber roving, unidirectional aramid fiber roving, continuous strand random fiber mat and/or balanced plain weave fiber fabric, and/or stitched layered fabric. The layup sequence is the stacking sequence of the various fiber orientations in an angular direction that is parallel to the longitudinal axis of the hockey stick shaft. In a pultrusion process, the fiber orientation would be axisymmetric. The layers 42–54, in the layup sequence of FIG. 3 from the outside surface 36 of the shaft 12 to the inside surface 34 are preferably constituted as follows:

1) Layer 42 consists of a single wrapping of a continuous strand glass fiber mat having a random pattern, and whose weight can vary from about 0.5 to 2 ounces per square foot. A suitable continuous strand glass fiber mat is sold under the designation "8641" by Owens Corning Fiberglass Co. The thickness of this layer can vary from about 0.006 to about 0.010 inches, and is preferably about 0.008 inches.
2) Layer 44 consists of a single wrapping of balanced 0°/90° plain weave glass fiber fabric, such as that sold by Mutual Industries, Philadelphia, Pa. under the brand name "Style 2964." The thickness of this layer can vary from about 0.010 to about 0.014 inches, and is preferably about 0.012 inches. When equivalent 0°/90° aramid fiber fabric is used in place of the glass fiber fabric, the thickness range of the layer can vary from about 0.006 to 0.014 inches, with a preferred thickness of about 0.010 inches;
3) Layer 46 consists of 0° unidirectional glass fiber roving, known as "continuous roving", such as that sold by Owens Corning Fiberglass Co., Toledo, Ohio. The thickness of this layer can vary from about 0.010 to about 0.014 inches, and is preferably about 0.012 inches;
4) Layers 48 and 50 are identical and consist of a single wrapping of balanced ±45° stitched layered glass fiber fabric, such as that sold under the brand name Knytex TM by Hexcel Co., Minneapolis, Minn. The thickness of each layer 50 and 48 can vary from about 0.013 to about 0.017 inches, and is preferably about 0.015 inches. When equivalent ±45° aramid fiber fabric is used in place of the glass fiber fabric, the thickness range of the layer can vary from about 0.009 to 0.017 inches, with a preferred thickness of about 0.013 inches;
5) Layer 52 consists of 0° unidirectional carbon fiber roving, such as that sold under the brand name Grafil TM Grade 34-700 by Mitsubishi Grafil Co., Sacramento, Calif. The thickness of this layer can vary from about 0.010 to about 0.014 inches, and is preferably about 0.012 inches;
6) Layer 54 is identical to layer 44 and consists of a single wrapping of balanced 0°/90° plain weave glass fiber fabric. The thickness of this layer can vary from about 0.010 to 0.014 inches, and is preferably about 0.012 inches. When equivalent 0°/90° aramid fiber fabric is used in place of the glass fiber fabric, the thickness range of the layer can vary from about 0.006 to 0.014 inches, with a preferred thickness of about 0.010 inches.

Layers 44 and 54 can also each comprise a single wrapping of a balanced 0°/90° stitched layered glass fiber fabric, such as that sold under the brand name Knytex TM by Hexcel Co.

In many situations it is desired to reduce the weight or to reinforce the strength of the hockey stick shaft by the substitution of some or all of the aforementioned layer materials with aramid fiber materials.

Aramid fibers are distinguished by low density, high tensile strength, a range of tensile stiffnesses, notable toughness characteristics, and non-linear, low-strength compressive behavior. Fiber density is about 40% lower than glass and about 20% lower than carbon. Tensile strength ranges from about 500 to $600\times10^3$ p.s.i. Tensile modulus ranges from about 12 to $25\times10^6$ p.s.i. Fiber toughness contributes to damage tolerance. Aramid composites exhibit ductile behavior when loaded in compression and flex and ultimate strength is lower than either glass or carbon composites.

Aramid fiber materials are widely available under the trademark Kevlar® from DuPont Co., Wilmington, Del. Aramid fibers, roving and fabrics in the same or equivalent form and configuration as the corresponding glass fiber and carbon fiber materials used in the present invention are available from the corresponding sources of glass fiber and carbon fiber materials.

The particular advantage of incorporating aramid fiber materials in the inventive hockey stick shaft is reduction in weight, and increased tensile strength, toughness and impact resistance.

A thin outside surfacing veil (not shown) made of a thermoplastic polyester, such as Nexus TM manufactured by Precision Fabrics Group, Greensboro, N.C., is used to provide the outer surface of the shaft with a smooth uniform surface. The surfacing veil is about 0.002 to 0.003 inches thick.

The wall thickness of the hockey stick shaft without aramid fiber materials can vary from about 0.07 to 0.1 inches, preferably about 0.075 to 0.095 inches and most preferably about 0.080 to 0.085 inches. When aramid fiber materials are used, the wall thickness can be reduced on the order of about 0.020 inches. The shaft 12 is preferably made using the technique of pultrusion.

The non-0° materials are fed from rolls of about 3.5 to 4.25 inches wide. The 0° unidirectional carbon fiber rovings can contain about 6000–48000 filaments per roving, and preferably about 24,000 filaments per roving, which are evenly distributed around the entire cross-section of the shaft. The 0° unidirectional glass fiber roving can vary from about 64 yards per pound yield to about 417 yards per pound yield, and most preferably about 247 yards per pound yield. Equivalent 0° unidirectional aramid fiber roving can also be used.

In the pultrusion production line, the innermost two layers, that is, the 0°/90° glass fiber fabric and the 0° unidirectional carbon fiber roving are fed into a preforming section and impregnated at a first impregnating zone with an epoxy resin, such as Glastic Grade 5227789, Glastic Corporation, Glastic, Ohio, or Shell Epon TM 828, Shell Chemical Company. Equivalent 0°/90° aramid fiber fabric and 0° unidirectional aramid fiber roving can also be used.

The resins of choice for impregnating and bonding the layup materials are epoxy resins, which have very low shrinkage during polymerization or curing and also have high strength to failure. Thus, epoxy resins are ideally suited for the preparation of the composite carbon fiber hockey stick shaft.

As the innermost two layers proceed along the production line, the two layers of ±45° stitch layered glass fiber fabric and the 0° glass fiber roving are added and impregnated with the epoxy resin at a second impregnating zone. Equivalent ±45 stitch layered aramid fiber fabric and 0° aramid fiber roving can also be used.

The final 0°/90° glass fiber fabric, the 8641 continuous strand glass fiber mat and the surfacing veil are then added to the production line and fed into a final impregnating zone that surrounds the entire layup production line. The final outside layers are then impregnated with the epoxy resin. On a weight basis, the epoxy resin comprises about 20% to 40%, and preferably about 30 weight % of the hockey stick shaft. As already indicated, equivalent aramid fiber fabric and mat can also be used to replace the glass fiber mat and the glass fiber fabric, in whole or in part.

The layup production line is then continuously pulled through a shaped orifice in a heated steel die to give the layup the geometry of the rectangular hockey stick shaft, as seen in FIG. 2. As the materials pass through the die, the epoxy resin and a suitable curing agent, such as methylene diamine or a mixed amine curing agent well known in the art, cures continuously to form a rigid cured profile corresponding to the hollow rectangular longitudinal shape of the hockey stick shaft.

The layup sequence in the production line is typically pulled through a die that can preferably vary from about 2 to 3 feet in length. The processing temperatures can vary from about 300° to 400° F., preferably about 300° to 320° F., and most preferably about 310° F. along the first half of the die, and preferably about 340° to 360° F., and most preferably about 350° F. along the second half of the die. Typical production line speed can vary from about 6 to 14 inches per minute and preferably about 10 inches per minute.

When the hockey stick 10 is used to hit a puck (not shown), the shaft 12 in reaction has a tendency to twist or be in torsion. The ±45° orientation of the two layers 46 and 48 of ±45° balanced stitched layered glass fiber fabric or equivalent aramid fiber fabric is believed to provide improved torque and twisting strength to the shaft 12. The additional torque and twisting strength of the shaft 12 provides improved resistance against breakage and distortion.

Another important aspect of the invention is that the 0° unidirectional carbon fiber roving should not be located in the central portion of the layup sequence. It has been found that improved physical properties occur when the 0° carbon fiber roving is located away from the central layer, and is preferably located adjacent to the inside surface or the outside surface of the hockey stick shaft.

The improvement in properties appears due to the fact that when the 0° carbon fiber roving is located in the central portion of the layup sequence, it does not significantly contribute to the overall physical properties of the hockey stick shaft. However, when it is located closer to the outer surface of the layup sequence, improved physical properties occur, particularly in terms of the flexural strength.

Thus, the closer the layer of 0° carbon fiber roving is to the inner or outer surface of the shaft, the more significant will be its contribution to enhanced physical properties, apparently because there is not a uniform stress state in the material. In the central portion there is almost no stress at all because the size of the carbon fiber is not significantly changing when there is bending. Thus, on one side (the outer side), the carbon fiber will stretch, and on the other side (the inner side) the carbon fiber will compress and there is a gradient across from the center line of the roving to the surface.

The closer the carbon fiber roving is to the surface, the greater effect it has in contributing to improved physical properties. The closer it is to the center, the less it will contribute. In a like manner, equivalent 0° unidirectional aramid fiber roving can also be used.

Although pultrusion is the preferred method for producing the improved carbon fiber hockey stick shaft, other methods can also be used, such as matched die molding or hand lamination of the multiple layers. The typical improved carbon fiber hockey stick shaft of the present invention has a length of about four feet. However, length can vary in accordance with individual preference. In addition, the layup sequence of materials can also vary.

The following examples are illustrative of the present invention:

EXAMPLE 1

In this example, A, B, C, D and E are each 8 inch wide by 12 inch long flat laminates of separate layup sequences. The materials in each layup sequence are tabulated in Table 1. The physical properties for each layup laminate are tabulated in Table 2. Each line item in the layup sequence is a single discrete layer of material. Each of the 0°/90° FG., 0° FG., 0° CF. layers were 0.012 inches thick. The 8641 layer was 0.008 inches thick and the ±45° FG. layer was 0.015 inches thick.

The layup was formed by placing one half of the layers (the first four layers in the 8 layer laminates of A, D and E and the first five layers in the 9 layer laminates of B and C) in a mold preheated to 300° F. 135 grams of Glastic 5227789 epoxy resin were poured into the center of the uppermost layer in the mold. The remaining plies were laid on top and 1400 psi pressure from an hydraulic press was then applied for five minutes.

TABLE 1

| A | B | C | D | E |
|---|---|---|---|---|
| 8641 | 8641 | 8641 | 8641 | 8641 |
| 0°/90° FG | 0° CF | 0°/90° FG | 0° CF | 0° FG |
| 0° FG | ±45° FG | ±45° FG | ±45° FG | ±45° FG |
| ±45° FG | 0°/90° FG | 0° FG | 0°/90° FG | 0°/90° FG |
| ±45° FG | 0° FG | 0° CF | 0°/90° FG | 0°/90° FG |
| 0° CF | 0°/90° FG | 0° FG | ±45° FG | ±45° FG |
| 0°/90° FG | ±45° FG | ±45° FG | 0° CF | 0° FG |
| 8641 | 0° CF | 0°/90° FG | 8641 | 8641 |
| | 8641 | 8641 | | |

TABLE 2

| Layup Sequence | A | B | C | D | E |
|---|---|---|---|---|---|
| Tensile Strength (psi) | 84,060 | 101,000 | 64,740 | 100,200 | 44,430 |
| Tensile Modulus (psi × $10^{-6}$) | 9.76 | 11.5 | 6.9 | 10.3 | 2.65 |
| Flex Strength (psi) | 66,410 | 78,890 | 54,260 | 78,060 | 71,890 |
| Flex Modulus (psi × $10^{-6}$) | 3.89 | 10.21 | 3.16 | 9.68 | 2.66 |
| Notched Izod (ft.-lb./in.) | 33.8 | 38.9 | 33.1 | 30.8 | 43.6 |

As seen from Table 1 and Table 2, the various configurations in the layup sequence can be changed to achieve the balance of properties desired by the user to achieve desired flexibility, stiffness (flex modulus) and strength (tensile strength).

It was observed that carbon fibers closer to the surface gave better physical properties. The highest impact strength (notched Izod) resulted with an all-glass fiber layup (E). There was a higher modulus with carbon than with glass fiber.

EXAMPLE 2

A fifteen year old Canadian hockey player used a number of different hockey sticks over a two-day period, including two prototypes of the inventive hockey stick shaft. The sticks were used to hit a standard National Hockey League hockey puck several times over a smooth ice surface on a day when the temperature was about 55°. The average speed of the puck was measured by a Sports-Star SL-300 hand held radar gun manufactured by Sports-Star Co. of Portland Oreg. There were appropriate rest intervals and stick rotation.

The average speed was calculated on the basis of 10 shots per day with each hockey stick, eliminating the highest and lowest speeds. The test results are tabulated in Table 3.

TABLE 3

| HOCKEY STICK MODEL | AVERAGE SPEED (M.P.H.) DAY 1 | DAY 2 |
|---|---|---|
| 1. EASTON STIFF FLEX[a] HXP 4900 GOLD | 67.37 | 68.25 |
| 2. EASTON W/ CARBON FIBER[a] HX A/C 7100 EXTRA STIFF | 66.38 | 68.00 |
| 3. EASTON GRETZKY[a] EXTRA STIFF HXP 5100 | 70.38 | 70.50 |
| 4. SHERWOOD PMP 7000[b] AL MACINNIS MODEL | 70.50 | 70.75 |
| 5. CAMAXX EXTRA STIFF[c] SCR 2000 | 72.37 | 71.87 |
| 6. CAMAXX STIFF FLEX[c] SCR 1000 | 74.25 | 74.62 |

[a]Easton Sports, Inc., Burlingame, California
[b]Sherwood Drolet Ltd., Sherbrooke, Canada
[c]Prototype of the invention. The layup sequence is as described in the aforesaid description of FIG. 3, with each layer having the preferred thickness. There were 10% more carbon fiber filaments in the SCR 2000 than the SCR 1000 hockey stick shaft. Additional resin replaced the reduced amount of carbon fiber roving in the SCR 1000 hockey stick shaft.

Some advantages of the inventive carbon fiber hockey stick shaft are as follows:

1) 20% lighter than aluminum;
2) Stronger than aluminum and wood;
3) Flexes well but does not bend permanently;
4) Feels like wood as compared to aluminum;
5) Has a much better gripping surface than aluminum;
6) No vibrations—aluminum has tremendous vibrations and needs styrofoam for stabilization;
7) The blade can be installed and removed with a heat gun rather than a blow torch and is thus safer to use and more convenient;
8) There is efficient removal of the blade or handle;
9) Cost is comparable to aluminum;
10) Has high capacity manufacturing capability without production problems;
11) The stick shoots harder and faster than either wood or aluminum;
12) Color will not chip;
13) There is a minimal fatigue factor in comparison with aluminum. Thus the stick retains accuracy throughout its life;
14) It is more durable and economical because there is minimal fatigue or breakage;
15) It is safer than wood or aluminum and there are no splinters or shards. If the stick breaks, there is a benign fracture;
16) Blades last longer because the shaft absorbs the impact.

Additional advantages of reduced weight, increased tensile strength, toughness and impact resistance are attained when aramid fiber materials are used to replace, in whole or in part, the carbon and glass fiber materials that form the discrete layers of layup material used to form the composite hockey stick shaft.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. In an elongated hollow tubular composite hockey stick shaft formed from a plurality of discrete layers of layup material selected from the group consisting of glass fiber mat, glass fiber roving, carbon fiber roving, woven fabric, stitched layered fabric, aramid fiber materials and mixtures thereof, the improvement which comprises including in the layup sequence;

(a) at least one layer "w" selected from the group consisting of ±45° balanced stitched layered glass fiber fabric and ±45° balanced stitched layered aramid fiber fabric at a central portion of the layup sequence;

(b) at least one layer "x" selected from the group consisting of 0° unidirectional carbon fiber roving and 0° unidirectional aramid fiber roving located away from the central portion of the layup sequence;

(c) at least one layer "y" selected from the group consisting of 0° unidirectional glass fiber roving and 0° unidirectional aramid fiber roving, said layer "y" adjacent to said layer "w"; and (d) at least one layer "z" selected from the group consisting of 0°/90° glass fiber fabric and 0°/90° aramid fiber fabric, said layer "z" adjacent to said layer "x".

2. The hockey stick shaft as claimed in claim 1, wherein said tubular shaft is of substantially uniform wall thickness.

3. The hockey stick shaft as claimed in claim 1, wherein the tubular shaft has opposite open ends and one of the opposite open ends adapted to receive a replaceable handle and the other opposite open end is adapted to receive a replaceable hockey blade.

4. The hockey stick shaft as claimed in claim 1, wherein the fiber orientations are measured from an angular direction that is parallel to the longitudinal axis of the hockey stick shaft.

5. The hockey stick shaft as claimed in claim 1, further including an outside surfacing veil of thermoplastic polyester.

6. The hockey stick shaft as claimed in claim 5, wherein the surfacing veil has a thickness range of about 0.002 to 0.003 inches.

7. The hockey stick shaft as claimed in claim 2, wherein the wall thickness of the tubular shaft varies from about 0.06 to 0.1 inches.

8. The hockey stick shaft as claimed in claim 1, wherein the layer thickness of 0°/90° fiber varies from about 0.006 to 0.014 inches.

9. The hockey stick shaft as claimed in claim 8, wherein the 0°/90° fiber is glass.

10. The hockey stick shaft as claimed in claim 8, wherein the 0°/90° fiber is aramid.

11. The hockey stick shaft as claimed in claim 1, wherein the thickness of the ±45° balanced stitched layered fabric varies from about 0.009 to 0.017 inches.

12. The hockey stick shaft as claimed in claim 11, wherein the ±45° stitched layer fabric is glass.

13. The hockey stick shaft as claimed in claim 11, wherein the ±45° stitched layer fabric is aramid.

14. The hockey stick shaft as claimed in claim 1, wherein the layer thickness of 0° unidirectional glass fiber roving varies from about 0.010 to 0.014 inches.

15. The hockey stick shaft as claimed in claim 1, wherein the layer "y" is aramid fiber roving.

16. The hockey stick shaft as claimed in claim 1, wherein the layer thickness of 0° unidirectional carbon fiber roving varies from about 0.010 to 0.014 inches.

17. The hockey stick shaft as claimed in claim 1, wherein the layer "x" is aramid fiber roving.

* * * * *